US006830365B2

(12) United States Patent
Kao

(10) Patent No.: US 6,830,365 B2
(45) Date of Patent: Dec. 14, 2004

(54) OUTDOOR ARTIFICIAL TREE

(75) Inventor: Cheung Chong Kao, Chai Wan (HK)

(73) Assignee: Boto (Licenses) Limited, Douglas (GB)

( * ) Notice: Subject to any disclaimer, the term of this patent is extended or adjusted under 35 U.S.C. 154(b) by 0 days.

(21) Appl. No.: 10/384,832

(22) Filed: Mar. 11, 2003

(65) Prior Publication Data

US 2004/0179374 A1 Sep. 16, 2004

(51) Int. Cl.[7] ..... A41G 1/00; F21V 29/02

(52) U.S. Cl. ..... 362/567; 362/373; 362/267; 362/580

(58) Field of Search ..... 362/565–568, 362/563, 564, 294, 373, 365, 123, 267, 450

(56) References Cited

U.S. PATENT DOCUMENTS 3,641,335 A * 2/1972 Wall ..... 362/567
3,766,374 A * 10/1973 Fairchild ..... 362/567
4,777,571 A * 10/1988 Morgan ..... 362/123
5,094,893 A 3/1992 Snider
6,062,701 A 5/2000 Hines
6,228,442 B1 5/2001 Coco
D451,431 S 12/2001 Kao
6,648,497 B2 * 11/2003 Puleo, Sr. ..... 362/568

* cited by examiner

*Primary Examiner*—Alan Cariaso
*Assistant Examiner*—Ali Alavi
(74) *Attorney, Agent, or Firm*—G. Brian Pingel; Camille L. Urban

(57) ABSTRACT

The present invention provides an artificial tree for use outdoors that includes a tree with trunk, branches and twigs protected from moisture penetration and a plurality of optical fibers also protected from the outside element. A housing encloses a light source assembly and a fan with a hood for protection from overheating. The housing includes a sloped overhang for moisture protection. A collar with a transparent closed end is inserted into an opening in the housing. The trunk of the tree fits into the collar with its bottom end and one end of every fiber abutting the transparent closed end of the collar. When the light source assembly is on, the tree is lit by the optical fibers and the light assembly is protected from moisture and overheating. An added protective feature is that the housing sits on legs such that there is clearance between the housing and the ground.

20 Claims, 5 Drawing Sheets

OUTDOOR ARTIFICIAL TREE

BACKGROUND OF THE INVENTION

1. Field of the Invention

The present invention relates in general to an artificial tree equipped with electrical connections and moving parts designed to tolerate the outdoor elements. The artificial tree of the present invention comprises beautifully shaped and lighted twigs, branches, and trunk resembling a tree in winter from which all the leaves have dropped.

2. Description of the Prior Art

It is known in the art to use artificial trees as decorative objects indoors. There are many, many different artificial Christmas trees available. Some of these indoor artificial trees are partially or totally preassembled; some come pre-lit with typical cord-and-bulb strings of lights; some include optical fibre lighting. There are also some decorative trees for outdoor use. Some of these include concentric, decreasing diameter hoops associated with a trunk member and lights. Another outdoor version contemplates the use of an existing pole such as a lamp post as a trunk member and provides a sleeve with branches and lights. For examples of these, see U.S. Pat. Nos. D451,431 S; 6,228,442; 6,062,701; and 5,094,893.

The present invention differs from the above referenced inventions and others similar in that these prior devices do not provide a tree that is specifically suited to outdoor use and protection from damage caused by the outdoor elements nor do they provide an articificial tree that features the shape and characteristics of a winter tree barren of leaves.

The first objective of the present invention is to provide an artificial tree wherein the trunk and branch members are assembled using a minimum of materials;

The second objective of the present invention is to provide an artificial tree specifically adapted to protect its branches, electrical circuits, and light source from wind, snow, and rain damage;

The third objective of the present invention is to provide an artificial tree with a light source which is equipped with means to protect against overheating;

The fourth objective of the present invention is to provide an artificial tree with branches that are life-like representations of those on a barren tree;

The fifth objective of the present invention is to provide an artificial tree wherein optical fiber lighting is used to create a color changing effect of the whole tree;

Finally, the sixth objective of the present invention is to provide an artificial tree wherein the electrical components are protected from snow and rain and are also positioned so as to avoid flooding problems presented by rain or melting snow.

SUMMARY

The present invention provides an artificial tree that includes a tree with trunk, branches and twigs; a plurality of optical fibers; a light source assembly and a housing for the assembly; and a stand. Such artificial tree differs from earlier inventions in that it is constructed simply of flexible material around which is wrapped adhesive tape for moisture resistance. The user can bend the branches and twigs to make a life-like and attractive appearing barren tree.

Optical fibers are aligned along the trunk, the branches, and each twig and are wrapped within the adhesive tape in such a manner as to position their lighted ends for aesthetic appeal and the other ends of the fibers are all gathered at the lower end of the trunk.

The housing is specially constructed to resist moisture and includes an opening in the top and a collar through which the lower part of the trunk is snugly fitted. The collar deflects water away from the opening. The housing is also constructed and equipped to prevent overheating by the light source. The housing construction includes an overhang through which air, but not moisture, can flow. A cooling fan with a hood to direct air flow, a thermostat and an auto-shut off mechanism are included in the housing also to prevent overheating.

Finally, a lamp, a color wheel, and a motor to turn the color wheel are provided. These elements are positioned so that the lamp shines light through the rotating color wheel to the ends of the optical fibers inserted with the lower part of the trunk through the opening in the top of the housing. In this way, the artificial tree can withstand the outdoor elements and provide an eye-pleasing decoration, lighted or unlit.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DESCRIPTION OF THE PREFERRED EMBODIMENT(S)

Figure 1:
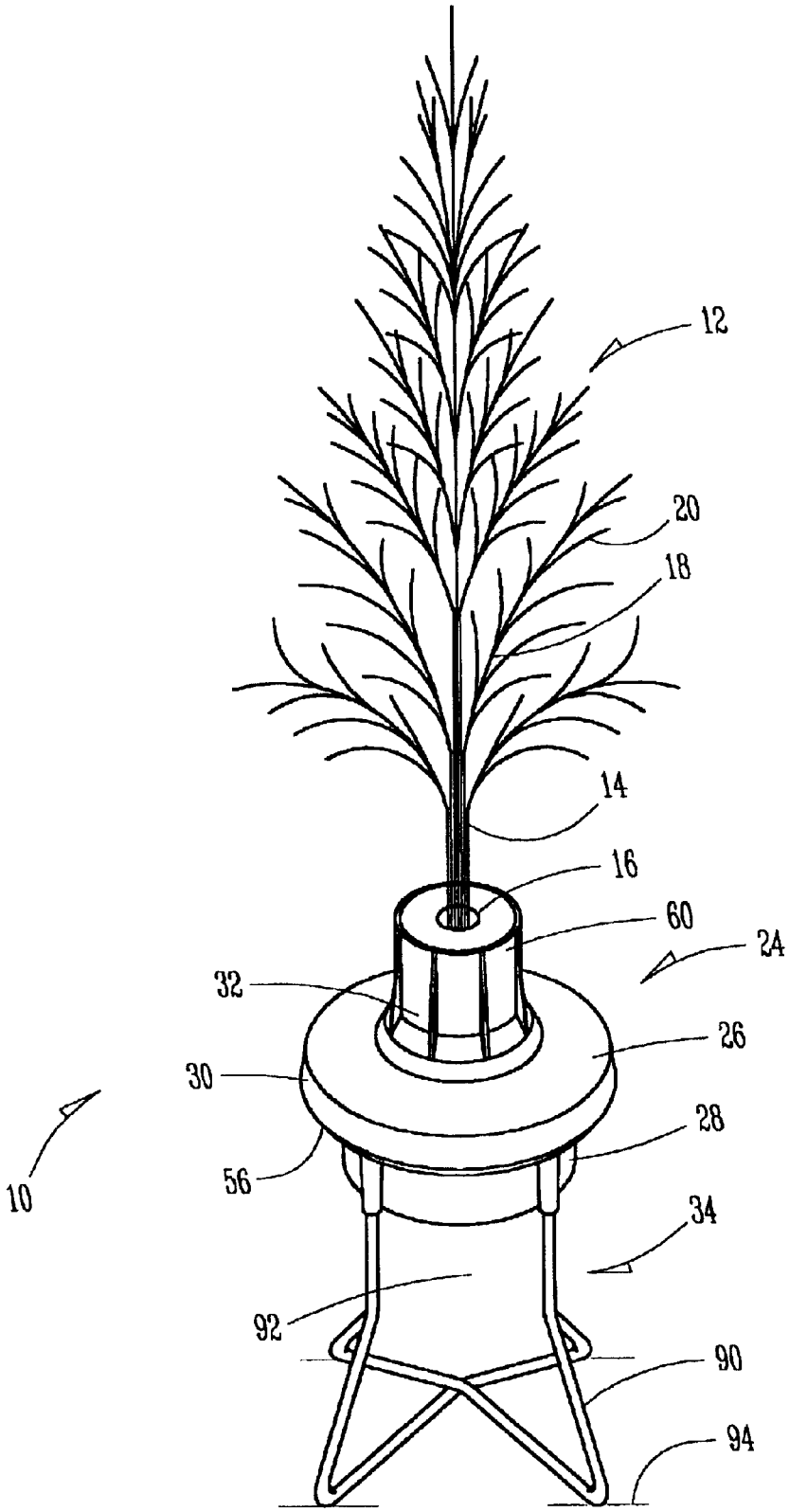
FIG. 1 is a perspective of the artificial tree of the present invention.

An artificial tree of the present invention is shown in FIG. 1 as reference number 10. Forming the tree 10 is a tree element 12 that comprises a trunk member 14 with a lower end 16, a plurality of branch members 18, and a plurality of twig members 20. A plurality of optical fibers 22, a housing 24 with an upper part 26, a lower part 28, an outer perimeter 30, and a collar 32, and a stand assembly 34 complete the outside appearance of the present invention.

Figure 2:
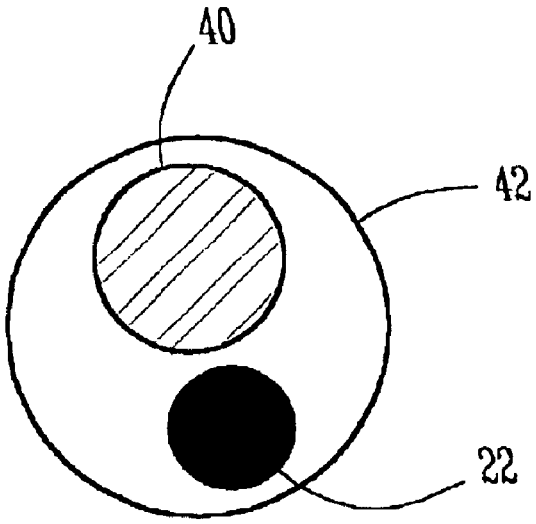
FIG. 2 is a cross-section of FIG. 1 along line 2—2.
Figure 3:
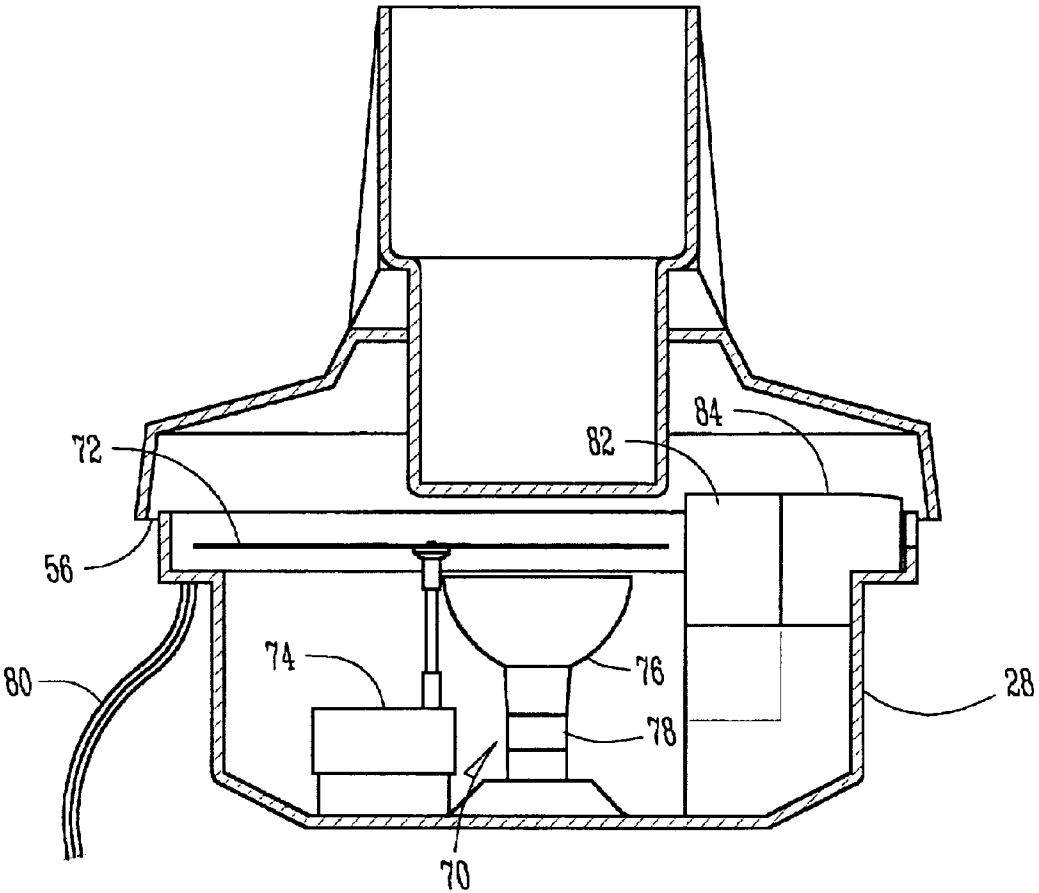
FIG. 3 is a side view of a housing shown in FIG. 1 with a partial cut away.

In the preferred embodiment, the tree element 12 is constructed using steel wire and adhesive tape to seal out moisture. As shown in the cross section FIG. 2, the steel wire 40 and optical fiber 22 are wrapped together with the adhesive tape 42 to make one of said plurality of branch members 18 or one of said plurality of twig members 20. This same manner of construction is used to wrap all the optical fibers 22 next to the trunk member 14 and to the lower end of the trunk 16.

Figure 4:
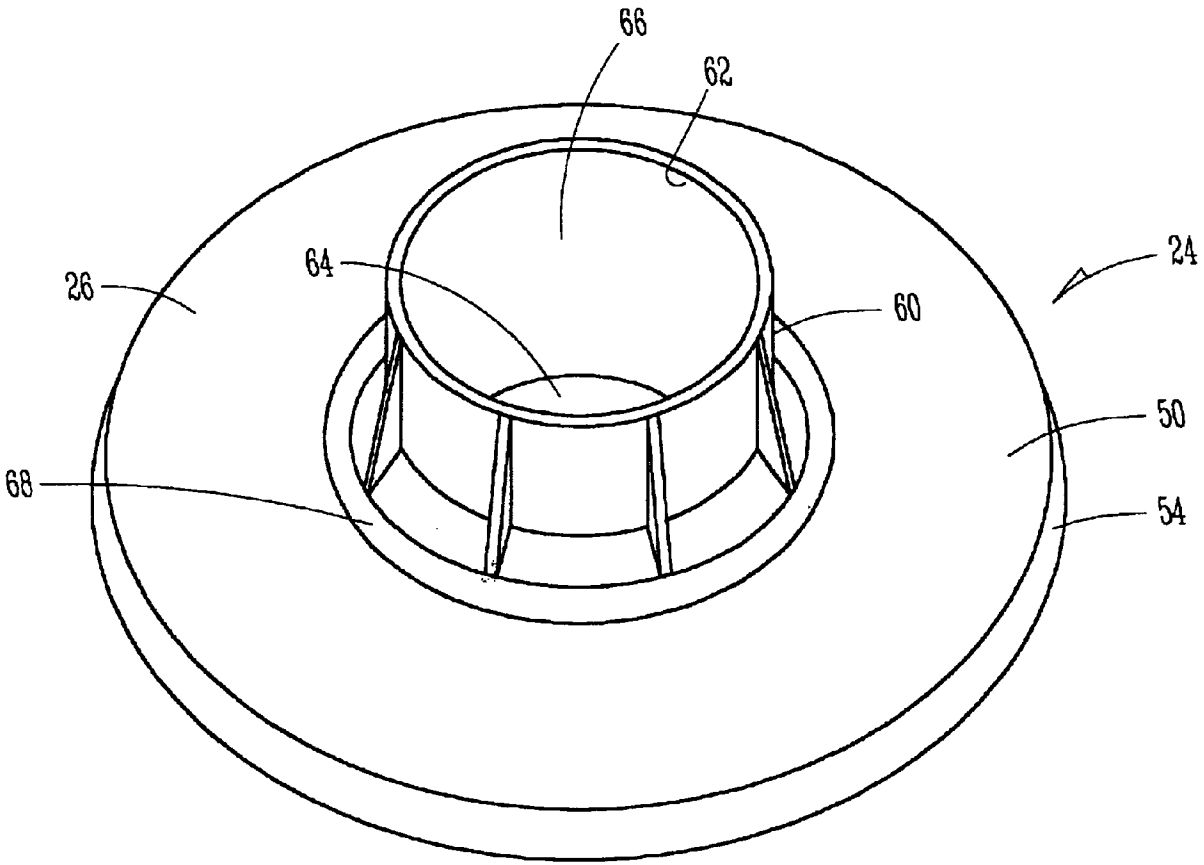
FIG. 4 is an enlarged perspective of the collar shown in FIG. 1.
Figure 5:
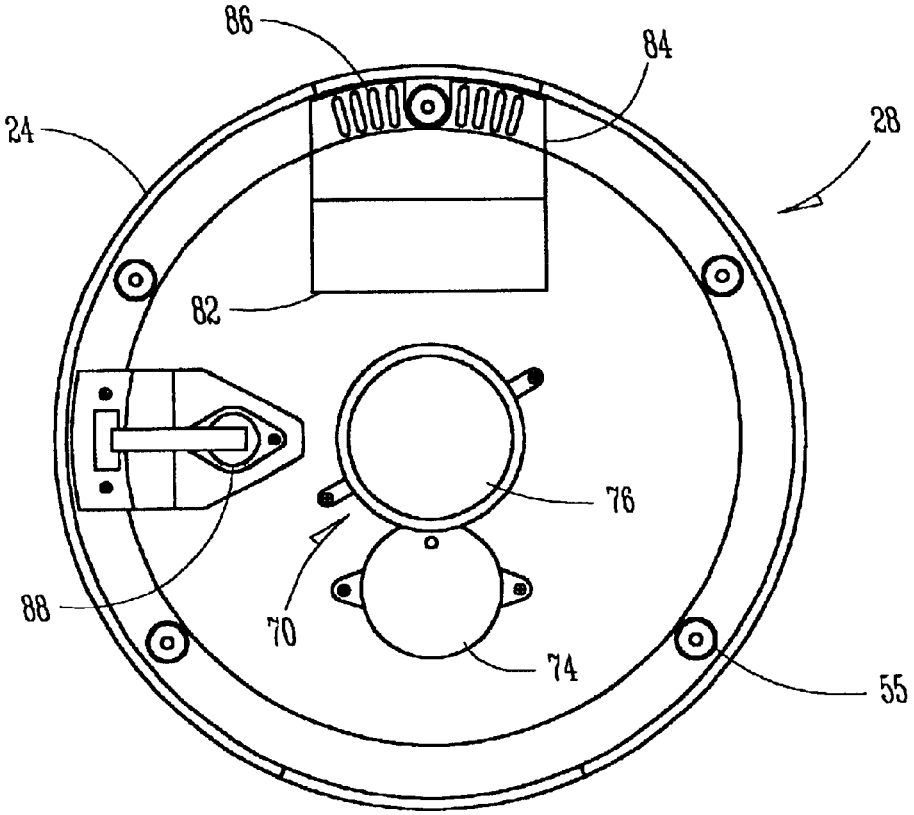
FIG. 5 is a top view of a lower part of the housing.

Referring now to FIG. 4, the housing 24 encloses means to resist penetration by rain and snow and means to protect against overheating. The housing upper part 26 has a top surface 50 with an opening 52 and fits over the housing lower part 28 in such a way as to provide a downwardly sloping overhang 54 which directs water away from the housing. There is a plurality of posts 55 provided where the housing lower part 28 and the housing upper part 26 meet creating a gap 56 between the two. This gap 56 allows air to pass in and out of the housing 24. A collar 60 is generally cylindrically shaped, basically transparent with an inner surface 62, a closed end 64, an open end 66, and includes a skirt 68. The collar 60 has a slightly larger diameter than the lower end of the trunk 16 to permit the lower end of the trunk 16 to be inserted in to the open end of the collar 66. The closed end of the collar 64 is then inserted in to the opening 52 in the top surface 50 for a purpose to be discussed below. In the preferred embodiment, the lower end of the trunk member 16 includes a cup-like structure 68 which abuts the inner surface 62 of the collar 60 and also catches any moisture in the form of rain or snow.

The housing 24 also encloses a light source assembly 70. In the preferred embodiment, the light source assembly 70 includes a colorwheel 72, a motor 74, a lamp 76, a lamp holder 78, and a power cord 80. To protect the light source assembly 70 from overheating, a cooling fan 82, a fan hood 84, and vents 86 are provided in addition to the gap 56 to provide means to prevent overheating. As an added measure of protection, the preferred embodiment also includes a thermostat 88 with an auto-shut off mechanism associated with a pre-set temperature.

The stand assembly 34 comprises legs 90 and is generally collapsible. The housing 24 is mounted on and associated with the stand assembly 34. The legs 90 of the stand assembly 34 allow air to pass between them and provide a clearance 92 between the housing 24 and a supporting surface 94 to guard against flooding and further assist with temperature control.

When the artificial tree 12 is assembled, the optical fibers 22 bundled with the lower end of the trunk member 16 and inserted in the collar 60 and the opening on the top of the housing 52 are positioned directly above the colorwheel 72 and the lamp 76 such that the optical fibers 22 provide light of changing colors on the branches and twigs.

Thus, the present invention has been described in an illustrative manner. It is to be understood that the terminology that has been used is intended to be in the nature of words of description rather than of limitation.

Many modifications and variations of the present invention are possible in light of the above teachings. For example, this invention could substitute a wheel with intermittent black and clear places for the color wheel thereby created a twinking tree without color change or the adhesive tape can be of any color to provide a variety of decorative effects. It would also be possible for the tree to include fiber optically lighted ornaments on the branches and twigs. Therefore, within the scope of the appended claims, the present invention may be practiced otherwise than as specifically described.

What is claimed is:

1. An artificial tree adapted for outdoor use comprising:

a) a tree element comprising a trunk member with a lower end, a plurality of branch members, and a plurality of twig members;

b) a plurality of optical fibers;

c) a light source assembly;

d) a housing for said light source assembly comprising means to resist penetration by rain and snow and means to protect against overheating;

e) a stand assembly comprising means for positioning said housing above and separated from a supporting surface; and f) means to protect against overheating comprising a cooling fan, vents, and a fan hood for directing in-flow of air to said fan.

2. An artificial tree as claimed in claim 1 wherein said trunk member, said plurality of branch members, and said plurality of twig members comprise steel wire and adhesive tape.

3. An artificial tree as claimed in claim 2 wherein said plurality of optical fibers each comprise a proximal portion which is associated with said lower end of said trunk member and a distal portion which is associated with one of said branch members or one of said twig members.

4. An artificial tree as claimed in claim 3 wherein said distal portions of each of said plurality of optical fibers is associated with the twig or branch member by wrapping said adhesive tape around said steel wire and said distal portion.

5. An artificial tree as claimed in claim 3 wherein said housing further comprises an upper part, a lower part, a top surface, and an opening over said light source assembly, and said means to resist penetration by rain and snow comprises a collar with an inner surface, a closed end inserted through the opening of said housing and an open end into which the lower end of said trunk member along with said proximal ends of said plurality of optical fibers are sealingly fitted.

6. An artificial tree as claimed in claim 5 wherein said lower end of said trunk member comprises a cup-like structure into which rain or snow may fall and which abuts the inner surface and the closed end of the collar.

7. An artificial tree as claimed in claim 1 wherein said housing further comprises an upper part, a lower part, an opening over said light assembly, and an outer perimeter and said means to protect against overheating includes an overhang around the outer perimeter of the housing and between said upper part and said lower part of the housing through which air is drawn to assist in cooling.

8. An artificial tree as claimed in claim 1 wherein said means to protect against overheating includes a thermostat and an automatic shut-off mechanism associated with said light source assembly which is activated at a pre-set temperature.

9. An artificial tree as claimed in claim 1 wherein said housing is supported by said stand assembly and said stand assembly is collapsible and comprises legs providing clearance of at least two inches from said supporting surface.

10. An artificial tree as claimed in claim 1 further comprising:

a) said housing also includes an opening over said light assembly and an outer perimeter;

b) said means to resist penetration by rain and snow comprises a collar with an inner surface, a closed end that is generally transparent, and an open end, mounted on the top of said housing over said opening and into which the lower end of said trunk member is sealingly fitted;

c) said lower end of said trunk member comprises a cup-like structure into which rain or snow may fall and which abuts the inner surface of the collar;

d) said means to protect against overheating includes an overhang and gap around the outer perimeter of the housing through which air is drawn to assist in cooling; and a thermostat with an automatic shut-off mechanism associated with said light source assembly which is activated at a pre-set temperature; and e) said stand assembly, above which said housing is positioned, comprises legs providing clearance between said housing and said supporting surface of at least two inches.

11. An artificial tree as claimed in claim 1, wherein said trunk member, said plurality of branch members, and said plurality of twig members comprise steel wire and adhesive tape; said plurality of optical fibers are each associated with said lower end of said trunk member which is positioned above said light source assembly and with a branch member or a twig member; and said source assembly comprises:

a) a color wheel;

b) a motor for rotating said color wheel;

c) a lamp;

d) a lamp holder attached to said housing; and e) a power cord, at least two electrical contacts, and at least one electrical circuit.

12. An artificial tree as claimed in claim 11 wherein said means to protect against overheating includes a thermostat with an automatic shut-off mechanism associated with said light source assembly and which is activated at a pre-set temperature.

13. An artificial tree adapted for outdoor use comprising:

a) a tree element comprising a trunk member with a lower end, a plurality of branch members, and a plurality of twig members;

b) a plurality of optical fibers;

c) a light source assembly;

d) a housing for said light source assembly comprising means to resist penetration by rain and snow and means to protect against overheating;

e) a collapsible stand assembly comprising means for positioning said housing above and separated from a supporting surface; and f) means to protect against overheating comprising a cooling fan, vents, and a fan hood for directing in-flow of air to said fan and a thermostat with an automatic shut-off mechanism associated with said light source assembly and which is activated at a pre-set temperature.

14. An artificial tree as claimed in claim 1 wherein said trunk member, said plurality of branch members, and said plurality of twig members comprise steel wire and adhesive tape.

15. An artificial tree as claimed in claim 2 wherein said plurality of optical fibers each comprise a proximal portion which is associated with said lower end of said trunk member and a distal portion which is associated with one of said branch members or one of said twig members.

16. An artificial tree as claimed in claim 3 wherein said distal portions of each of said plurality of optical fibers is associated with the twig or branch member by wrapping said adhesive tape around said steel wire and said distal portion.

17. An artificial tree as claimed in claim 3 wherein said housing further comprises an upper part, a lower part, a top surface, and an opening over said light source assembly, and said means to resist penetration by rain and snow comprises a collar with an inner surface, a closed end inserted through the opening of said housing and an open end into which the lower end of said trunk member along with said proximal ends of said plurality of optical fibers are sealingly fitted.

18. An artificial tree as claimed in claim 5 wherein said lower end of said trunk member comprises a cup-like structure into which rain or snow may fall and which abuts the inner surface and the closed end of the collar.

19. An artificial tree as claimed in claim 1 wherein said housing further comprises an upper part, a lower part, an opening over said light assembly, and an outer perimeter and said means to protect against overheating includes-an overhang around the outer perimeter of the housing and between said upper part and said lower part of the housing through which air is drawn to assist in cooling.

20. An artificial tree as claimed in claim 1 wherein said housing is supported by said stand assembly and said stand assembly comprises legs providing clearance of at least two inches from said supporting surface.

* * * * *